US005507422A

United States Patent [19]

Shields

[11] Patent Number: 5,507,422

[45] Date of Patent: Apr. 16, 1996

[54] CONTOURED PAD FOR A SHOULDER STRAP

[76] Inventor: Peter Shields, P.O. Box 91, Mammoth Lakes, Calif. 93516

[21] Appl. No.: 292,864

[22] Filed: Aug. 19, 1994

[51] Int. Cl.[6] ..... A45F 3/12

[52] U.S. Cl. ..... 224/264; 2/268; D3/327; D2/639

[58] Field of Search ..... 224/202, 264; 2/267, 268, 2; D3/327; D2/639

[56] References Cited

U.S. PATENT DOCUMENTS

| | | | |
|---|---|---|---|
| D. 360,288 | 7/1995 | Freeman et al. | D2/639 |
| D. 360,745 | 8/1995 | Nicholson et al. | D2/639 |
| 2,519,401 | 8/1950 | Rockwell . | |
| 2,519,637 | 8/1950 | Davis . | |
| 2,534,513 | 12/1950 | Gerry | 2/268 |
| 2,633,573 | 7/1953 | Sanders . | |
| 3,799,413 | 3/1974 | McBain . | |
| 4,040,147 | 8/1977 | King | 224/264 |
| 4,575,874 | 3/1986 | Johnson . | |
| 4,879,768 | 11/1989 | McClees et al. . | |
| 4,887,318 | 12/1989 | Weinreb . | |
| 5,129,101 | 7/1992 | Douglas . | |
| 5,159,715 | 11/1992 | Jurga et al. . | |
| 5,250,345 | 10/1993 | Chu . | |
| 5,441,188 | 8/1995 | Rosenstein | 224/264 |

FOREIGN PATENT DOCUMENTS

| | | |
|---|---|---|
| 86924 | 2/1956 | Finland . |
| 0218088 | 8/1990 | Japan . |
| 521222 | 5/1940 | United Kingdom . |
| 585636 | 2/1947 | United Kingdom . |

*Primary Examiner*—Henry J. Recla
*Assistant Examiner*—Gregory M. Vidovich
*Attorney, Agent, or Firm*—Lyon & Lyon

[57] ABSTRACT

A shoulder pad for use with a shoulder strap for improving the distribution of the weight on a user's shoulder of an object carried by the strap thereby reducing the discomfort to the user and the tendency of the strap to slide off the user's shoulder. The shoulder pad comprises an arcuate shoulder strap support surface and one or more inclined wedges transversing the support surface between the inner and outer edges thereof. The wedges are inclined upwardly toward the outer edge of the support strap. A strap securement clip is removably secured about a centrally disposed wedge, pinching portions of the shoulder strap about the wedge and causing the strap to turn outwardly from the wedge and securing the pad to the strap. A pair of strap retention members are spaced slightly above and transverse the strap support surface proximate the extended ends thereof to hold the portions of the shoulder strap thereunder against the support surface, thereby cooperating with the securement clip to cause the strap bear against any laterally disposed secondary wedges on the support surface and turn outwardly therefrom. As a result of the turns provided in the strap by the pad, the strap substantially follows the contour of the user's shoulder and projects downwardly therefrom at an outward declination toward the object carried by the strap, effectively distributing the load on the strap across the pad to a larger area of the user's shoulder.

28 Claims, 4 Drawing Sheets

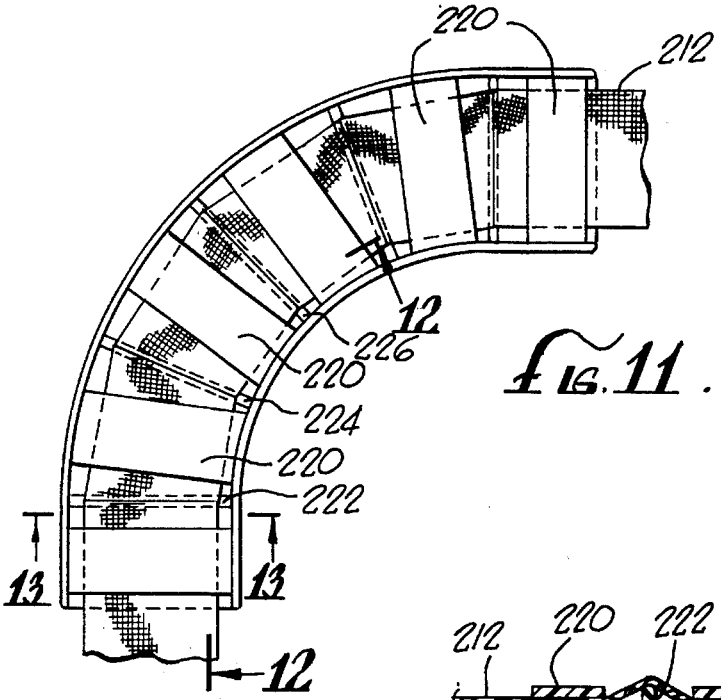
FIG. 11.
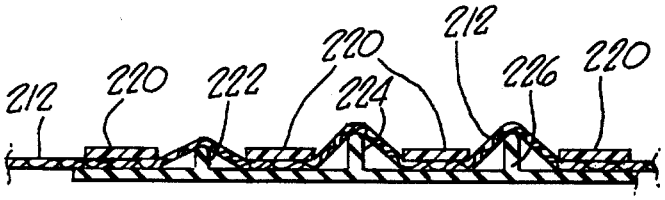
FIG. 12.
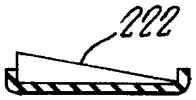
FIG. 13.
FIG. 14.
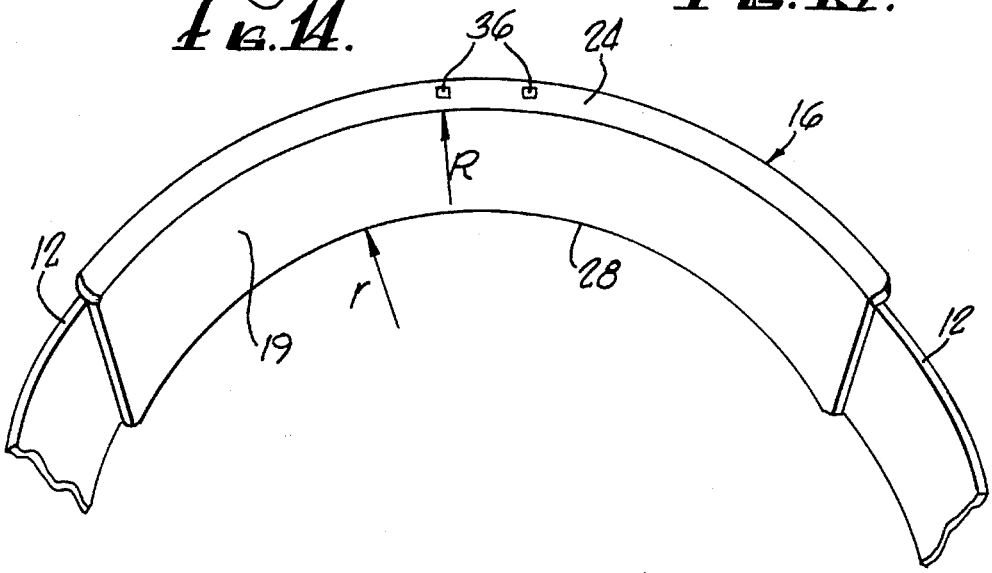

CONTOURED PAD FOR A SHOULDER STRAP

BACKGROUND OF THE INVENTION

The present invention relates to an improvement in pads for use with shoulder straps. The use of straps extending across one shoulder to carry luggage, camera and computer equipment, large purses and a wide variety of other items is commonplace. While such straps are convenient as they free the user's hands, they quickly become uncomfortable, particularly with heavier loads, and continually tend to slide off the user's shoulder. These problems result from the fact that peoples' shoulders are not square but somewhat rounded and slope downwardly in varying degrees from the base of the neck to the point of the shoulder and from the shoulder's apex to the upper chest and back region. Shoulders are also typically thicker proximate the neck area than at the outer point of the shoulder. Thus, the weight of the shoulder bag or other object being carried by a flat strap causes the inner portion of the strap proximate the neck to tend to "dig" uncomfortably into the shoulder and the strap to slide down and off the shoulder.

The discomfort and sliding problems experienced with shoulder straps are compounded by the fact that the user's hip and waist regions prevent an object carried from a shoulder strap from hanging directly under the area of the shoulder against which the strap bears. The object is forced outwardly from such area so that the strap hangs at an outward declination, increasing the angle of inclination of the strap on the shoulder and thereby limiting the effective area of the strap which is pulled downwardly against the shoulder to the portion of the strap adjacent its inner edge. Concentrating the load of the object carried by the strap to such a narrow portion thereof and thus to a very small area of the shoulder, increases both the discomfort in the shoulder and the tendency of the strap to slide off the shoulder. The wider the load carried by the strap, the more the strap declines outwardly from the shoulder and the more acute these problems become.

Considerable effort has been expended in attempting to solve these problems and a wide variety of shoulder pads and anti-slip devices have been developed for use with shoulder straps. While providing some improvement over a bare uncushioned strap, such devices have not proved successful in solving these problems and in many cases have created additional problems.

The most commonly employed solution to the discomfort problem is simply to provide a soft cushioned pad for the strap which typically includes a plurality of slits or loops through which the strap may be inserted to secure the pad onto the strap. While providing some cushioning between the strap and the shoulder, such pads do not address the angular relationships between the contours of the user's shoulder and the shoulder strap hanging thereacross at a slightly outward declination. As a result, the pad bears against the shoulder predominately along the inner edge portion of the pad and the weight of the load is still transmitted to the shoulder over a very small area. Because of the concentration of the load on the shoulder, the cushioning effect of the pad is relatively ineffective and discomfort quickly results and increases with time. In addition, these cushioned pads tend to slide back and forth along the strap, requiring frequent adjustment. To attach many of such pads to a shoulder strap it is first necessary to detach one end of the shoulder strap from the object being carried which often is not possible with many bags fitted with shoulder straps.

Many of these cushioning pads are comprised of a plurality of materials, typically including a lower soft layer and a stiff upper layer or layers. Such composite pads are not only more expensive to manufacture but have a tendency to tear or separate at the junctions of the different materials and at locations where the strap is extended through or between the materials comprising the pad. Again, such composite pads have not addressed the angular relationship between the strap, the pad and the shoulder. As a result, these cushioning pads have not provided an adequate solution to the discomfort created by shoulder straps. They are also often awkward to use, frequently tend to deteriorate prematurely and do relatively little to address the problem of holding the strap in place on the user's shoulder.

The most commonly employed solution to the slippage problem is to provide a pad having a non-uniform lower surface provided with projecting ridges or small spiked-like projections which increase the friction between the pad and the user's clothing. The angular relationship between these pads and the user's shoulder again inhibits their effectiveness in holding the strap in place. Such pads still tend to slide down the user's shoulder, pulling on his or her shirt and making such devices uncomfortable to use.

Wedge-shaped pads have also been developed in an effort to provide a horizontal base for the shoulder strap and thereby reduce the tendency of the strap to slide off the user's shoulder. Examples of such devices are found in U.S. Pat. Nos. 4,887,318 and 5,250,345. While reducing somewhat the tendency of the strap to slide off the shoulder, such devices do not solve the problem. As noted above, the anatomical configuration of the human form does not allow a bag to hang from a shoulder strap directly under the area on the shoulder in contact with the bag. The hips and waist areas force the bag outwardly, causing the shoulder strap to extend both downwardly and outwardly. Thus, even when a horizontal platform is provided for the strap, the vector forces generated by the outward disposition of the bag continue to tend to pull the bag outwardly along the downward slope of user's shoulder. In addition, these directional forces cause the inner edge portion of the strap to bear against the pad more forcefully than the mid and outer portions of the strap. Accordingly, only a narrow portion of the pad absorbs the great majority of the weight of the bag. As a result, the horizontal base does little to spread the concentration of the load carried by the strap over a larger portion of the shoulder. Thus, the discomfort associated with shoulder straps is not appreciably relieved by the use of wedge-shaped pads.

The contoured pad of the present invention provides a solution to both the discomfort and slippage problems discussed above. By configuring the pad such that it contours the strap in the shoulder area so as to mate with the contour of the shoulder and projects therefrom at an outward declination toward the object carried by the strap, the entire width of the pad effectively absorbs the weight of the load carried by the strap and transmits that load to a larger area of the shoulder. As a result the concentration of the load on the shoulder and the discomfort resulting therefrom are significantly diminished. In addition, such a contour tends to maintain the strap in place on the shoulder. The shoulder pad of the present invention obtains these results without the need for bulky padding or joined multiple materials and is of economical construction and readily secured in place on the shoulder strap.

These results are achieved in the present invention by configuring the shoulder pad such that it defines a continuous convex arcuate strap support surface periodically interrupted by one or more upstanding projections defining apexes adjacent the outer edge of the support surface for elevating isolated portions of the strap at an outward inclination above adjacent portions of the support surface. A plurality of strap retention members hold the shoulder strap against the portions of the strap support surface adjacent the projections so as to force the strap against the projections and cause the strap to incline outwardly and laterally about each of the projections. In so doing, the strap turns outwardly on the support surface about each of the projections. By imparting such inclined turns into the strap, the pad of the present invention effectively contours the portion of the strap extending over the support surface defined by the pad to the outer surface of the user's shoulder and redirects the strap from the ends of the pad at an outward declination toward the object carried by the strap. To provide a more even distribution of the load on the strap across the shoulder pad, the projections therein are preferably defined by inclined wedges in the strap support surface transversing adjacent portions thereof. Such a configuration provides a continuous support surface for the strap as it turns thereon over the user's shoulder.

IN THE DRAWINGS

FIG. 11 is a schematic representation of a device incorporating the principles of the present invention and illustrating the contouring of a strap secured thereto for alternative applications.

FIG. 12 is a sectional view taken along the line 12—12 in FIG. 11.

FIG. 13 is a sectional view taken the line 13—13 in FIG. 11.

FIG. 14 is a schematic representation of a shoulder pad of the present invention wherein the pad is inclined upwardly from the inner edge thereof to the outer edge.

DESCRIPTION OF THE PREFERRED EMBODIMENTS

Figure 1:
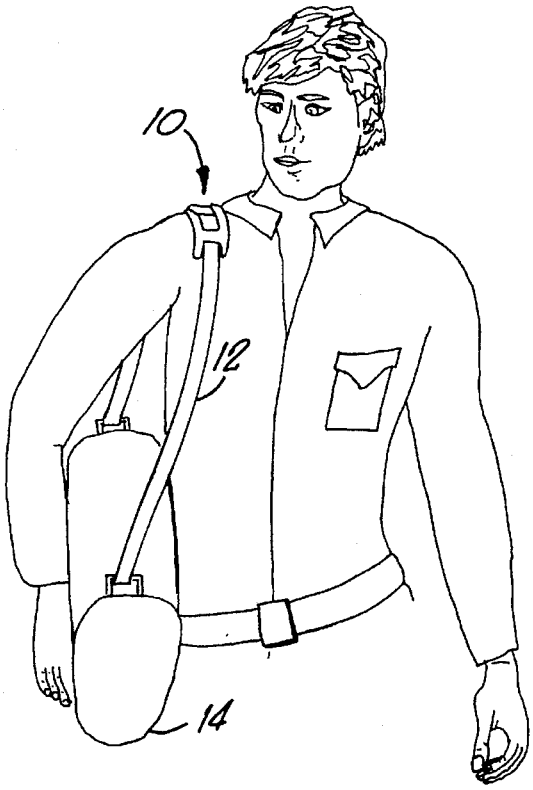
FIG. 1 is a perspective view illustrating the use of the present invention.
Figure 2:
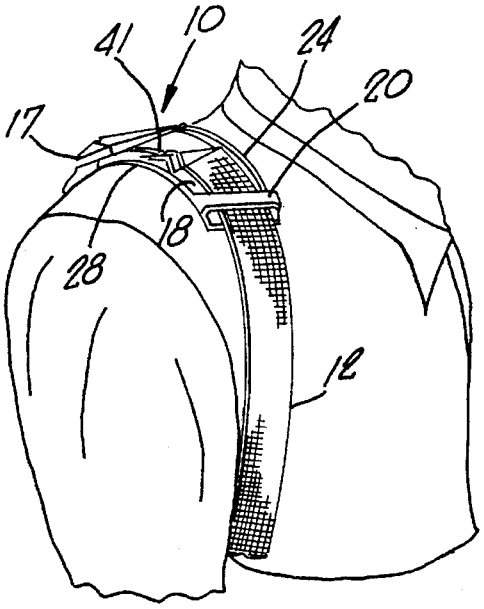
FIG. 2 is an enlarged perspective view illustrating the use of the present invention.

Referring now in detail to the drawings, FIGS. 1 and 2 illustrate the use of the contoured pad 10 of the present invention on a conventional flat shoulder strap 12 to comfortably carry a bag 14 secured to the extended ends of the strap. In the embodiment of the invention shown in FIGS. 1—8, the pad 10 is particularly designed to be adjustably affixed to the strap and can only be removed from the strap by undoing one end of the strap from bag 14. This embodiment is particularly suited for use by original equipment manufacturers wherein the pad 10 is provided on the strap 12 prior to securement of the strap to the bag. An embodiment of the invention illustrated in FIGS. 9 and 10 is designed as a retrofit for a flat shoulder strap which can be easily added to the strap without undoing the securement of the strap to the bag 14. With either embodiment, the positioning of the pad along the strap can be readily adjusted as desired, but once secured, will not easily slide along the strap during normal use.

Figure 3:
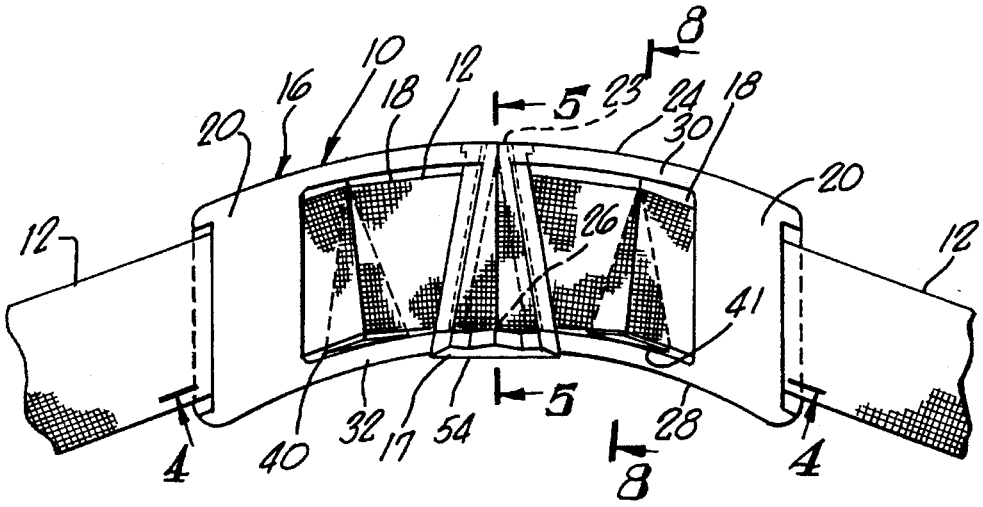
FIG. 3 is a top plan view of the pad of a first embodiment of the present invention with a shoulder strap secured thereto.
Figure 4:
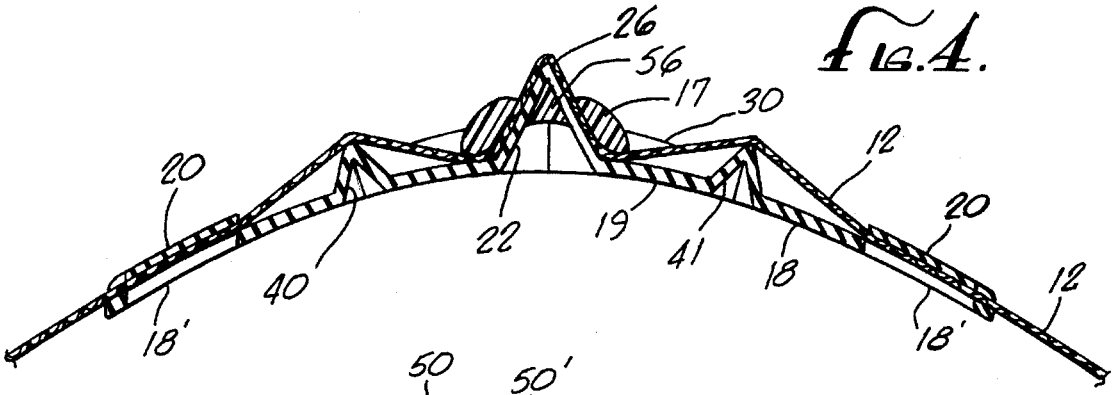
FIG. 4 is a sectional view taken along the line 4—4 in FIG. 3.
Figure 6:
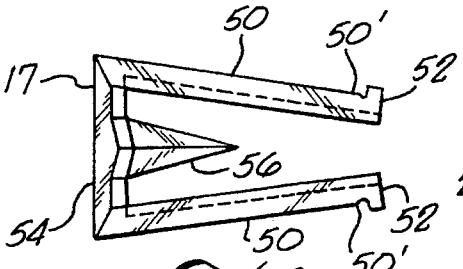
FIG. 6 is a top plan view of the locking clip employed in the first embodiment of the present invention.
Figure 7:
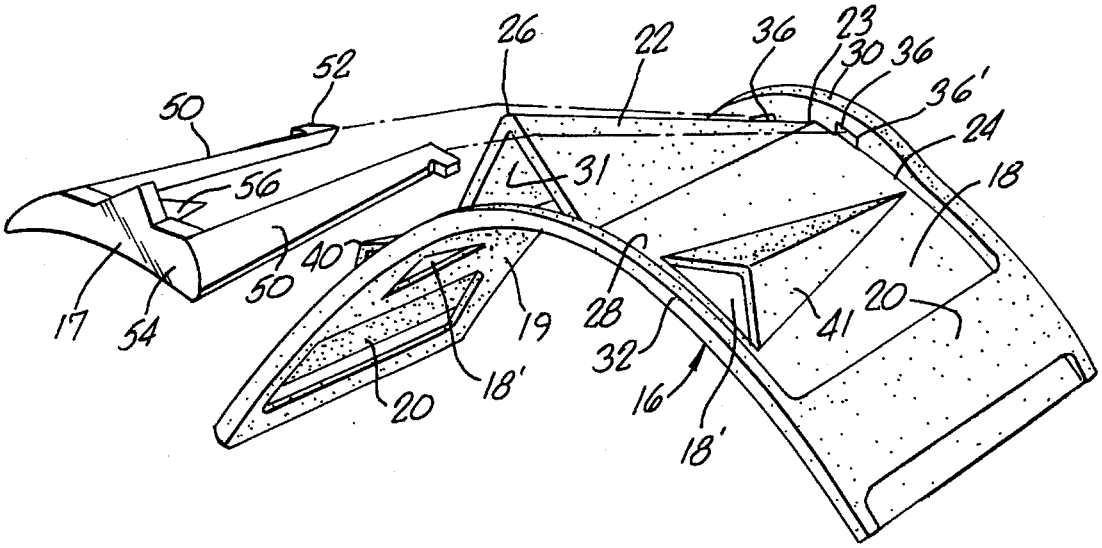
FIG. 7 is an exploded perspective view of the pad and locking clip of the first embodiment of the present invention.

The pad 10 is shown in FIGS. 3 and 4 secured to strap 12, while the components of the pad 10 are illustrated separately in FIG. 7. As seen in FIG. 7, the pad 10 comprises a body portion 16 and a separate strap securement clip 17. The body portion of the pad is preferably molded of a flexible plastic material such as thermoplastic rubber or vinyl while clip 17 is preferably formed of a relatively rigid plastic material. Body portion 16 is bowed so as to define a convex and arcuate strap support surface 18, a concave shoulder abutment surface 19, and a pair of raised strap retention webs 20 extending across the body portion 16 of the pad above surface 18 proximate the ends thereof. The strap support surface 18 defines a centrally disposed upstanding wedge 22 which extends from a mid-point 23 on the inner edge 24 of support surface 18 upwardly and outwardly to an outer apex 26 substantially contiguous with the outer edge 28 of the support surface 18. The terms "inner" and "outer" are used herein to define positions relative to the user's neck when the shoulder pad 10 is secured to a strap 12 extending over the user's shoulder as illustrated in FIGS. 1 and 2. The inner edge 24 of support surface 18 is thus disposed proximate the user's neck and the outer edge 28 is more proximate the point of the shoulder.

Figure 5:
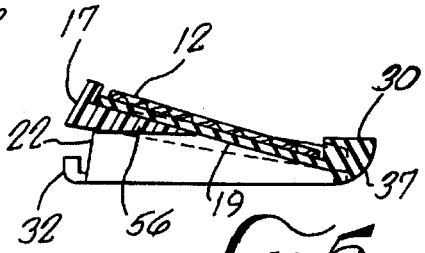
FIG. 5 is a sectional view taken along the line 5—5 in FIG. 3.

A raised lip 30 extends along the inner edge of the strap support surface 18 and a raised lip 32 extends along the outer edge of the support surface transversing wedge 22. The inner lip 30 is elevated slightly over a central portion thereof to accommodate a pair of elongated clip receiving slots 36 disposed on opposite sides of the inner lower end of wedge 22. As seen in FIG. 5, the lower inner edge 37 of lip 30 is radiused to avoid any sharp corners adjacent the user's neck and shoulder.

The strap support surface 18 of pad 10 also preferably defines a pair of transversely extending secondary wedges 40 and 41 therein spaced between the centrally disposed wedge 22 and webs 20. In the embodiment of the invention shown in FIGS. 1–8, the secondary wedges 40 and 41 are generally of the same configuration as central wedge 22 but are smaller than wedge 22 in width, height and length and are spaced inwardly from the raised lips disposed along the inner and outer edges 24 and 28 of support surface 18. As noted later herein, other configurations of secondary wedges 40 and 41 and central wedge 22 could be also employed. The strap securement webs 20 span lips 30 and 32 and are raised from support surface 18 to accommodate portions of the shoulder strap 12 therebetween.

The securement clip 17 is generally of a U-shaped configuration and defines a pair of slightly inwardly inclined leg portions 50 terminating in inwardly projecting locking tabs 52, a bar portion 54 spanning leg portions 50 and wedged shaped projection 56 extending from bar portion 54 between leg portions 52. Projection 56 tapers downwardly and inwardly from bar portion 54 and terminates equidistantly between leg portions 52. The extended ends 50' of the leg portions of clip 17 adjacent locking tabs 52 are spaced apart a distance slightly greater than the side walls 36' of clip receiving slots 36 for the securement of the leg portions therein as will be discussed.

To secure the shoulder strap 12 to pad 10, an end portion of the strap is inserted between one of the raised webs 20 and the strap support surface 18 and extended over the strap securement surface 18 and wedges 40, 22, and 41. The strap is then inserted between the other raised web portion 20 and the adjacent portions of the support surface 18. The body portion 16 of pad 10 is then slided to the midpoint of the shoulder strap. The shoulder pad 10 is then secured in place by pressing the portions of the strap disposed over the central wedge 22 against the upper inclined surfaces of wedge 22, pressing the leg portions 52 of the securement clip 17 slightly inwardly toward each other and sliding the clip into the locking position such that the locking tabs 52 thereon extend through the slots 36 in the inner lip 30 and the wedge shaped projection 56 on clip 17 extends into the triangular channel 31 below wedge 22. Upon releasing the flexed leg portions 52 of clip 17, the leg portions will flex outwardly such that the end portions 50' thereof adjacent locking tabs 52 will abut the side walls 36' of slots 36 with the locking tabs 52 projecting laterally from slots 36 adjacent an exterior surface on raised lip 30. So disposed, the securement clip 17 is held in place on the body portion 16 of the pad and pinches the portion of the shoulder strap disposed between clip 17 and wedge 22 tightly therebetween.

The configuration of wedge 22 against which the shoulder strap is tightly pressed by clip 17 causes the shoulder strap to turn outwardly about wedge 22 such that the strap extends from wedge 22 along the central portion of arcuate strap support surface 18 of pad 10. When the shoulder strap is pulled tightly against the support surface 18 of pad 10 by pulling on the portions of the strap projecting from the pad 10, similar but slightly less sharp outward turns are effected in the shoulder strap about the secondary wedges 40 and 41. This results because of the tapered inclination imparted to the portions of the strap 12 extending over wedges 40 and 41 as the strap is pulled tightly across the pad and is forced against the wedges due to the underside of leg portions 50 of clip 17 and the securement webs 20 collectively pressing adjacent portions of the strap against support surface 18 on opposite sides of each of the secondary wedges. As a result, the strap turns slightly outwardly along the central axis of the arcuate pad and projects therefrom at an outward declination toward the bag 14 carried by the extended ends of the shoulder strap 12. While the strap securement wedges 20 extend across the strap support surface 18, open areas or windows 18 can be provided in the support surface 18 under webs 20 to reduce material costs and facilitate the formation of the secondary wedges in the molding process without affecting the ability of the webs to hold the strap against wedges 40 and 41 (see FIGS. 4 and 7).

The angle at which the shoulder strap 12 is bent as it passes over and is pressed against the wedges formed in the strap support surface 18 depends on the angle of inclination defined by the upper surface of the wedge with respect to the support surface 18, the length of the wedge, which in turn determine the elevation of the apex of the wedge relative to the support surfaces, and the proximity of the strap retention members (clip 17 and webs 20) to the wedges. The greater the distance the apex of the wedge is elevated above the support surface and the closer the strap retention members is to the wedge to force the strap about the wedge, the sharper the angle at which the strap is bent as it passes over the wedges. Thus, pad 10 could, if desired, be configured for particular shoulder configurations, e.g., muscular and slender builds, by varying the angle of inclination of the upstanding wedges in support surface 18, the length of the different wedges and/or spacing between the wedges and a strap retention member. Thus, by increasing the angle of inclination of central wedge 22, the secondary wedges 40 and 41 could be eliminated and a sufficient turn imparted to the strap about wedge 22 such that the strap would project from the ends of pad 10 at a slightly outward declination as illustrated in FIGS. 1–3. However, the addition of the secondary wedges 40 and 41 cause the shoulder strap 12 to bend at three spaced locations on the support surface 18 of pad 10 and thereby more closely mate with the contour of a typical shoulder as the strap passes through the shoulder pad. The more closely the strap mates with the contour of the shoulder, the more evenly the weight of the load is distributed throughout the pad, thus the greater the comfort and the less the strap will tend to slide down the shoulder.

In the event only a single centrally disposed wedge was provided on support surface 18, the strap securement webs 20 would not be necessary to effect angular turns in the shoulder strap. The strap would solely turn about the central wedge. Webs 20 would preferably still be utilized, however, to assist clip 17 in securing the pad to the strap.

It should also be noted that other configurations of upstanding projections could be provided on support surface 18 proximate the outer edge 28 of the pad in lieu of inclined wedges transversing surface 18 to elevate the outer portions of the strap at spaced locations such that the strap could be pinched about such projections to effect outwardly angled turns in the strap. The use of inclined wedges transversing the support surface 18 is preferred, however, as the upper surfaces thereof provide running support surfaces for the strap across the width of the strap support surface or at least substantial portions thereof and thereby provide a more uniform load distribution across the strap. In addition, by employing a strap having a width less than the transverse dimension of the strap support surface 18 of the pad, the use of an inclined wedge allows the strap to be secured about the wedge at different elevations thereon. Thereby varying the angle of the turn which can be imparted to the strap about the wedge. Thus, such pad and strap combination would be adjustable to contour the strap somewhat more closely to shoulders of different dimensions.

In use, the shoulder strap 12 transverse the user's shoulder as seen in FIGS. 1 and 2 such that the inner edge 24 of the body portion 16 of the pad faces the user's neck and the outer edge 28 faces the point of the shoulder. As the weight of the bag 14 presses the underside of pad 10 against the shoulder, the outwardly angled turns in the strap imparted thereto by wedges 22, 40 and 41, clip 17 and webs 20 cause the strap to follow closely the curvature of the shoulder and extend downwardly and outwardly from the pad toward the bag in directions substantially coincident with the resultant force vectors transmitted to the shoulder by the weight of the bag. As a result, the weight of the bag is effectively spread substantially throughout the portion of the shoulder disposed under the pad 10 as opposed to being concentrated in a considerably smaller region under an inner edge portion of the pad as occurs with the prior art. With the pads constructed in accordance with the teachings of the prior art, the great majority of the weight of the bag is typically absorbed by the portion of the shoulder disposed under the inner edge portion of the pad. By so substantially increasing the area of the shoulder against which the load of the bag is transmitted, the comfort level of carrying the bag is substantially increased. Further, by contouring the strap around the shoulder toward the hanging bag 14 as above-described, the tendency of the bag to slide off the shoulder is substantially reduced.

It is significant to note, that the bends in the shoulder strap about wedges 22, 40 and 41 do not necessarily define equal radii of curvature as viewed by the upper surface of the shoulder as would occur if one could manufacture a flat arcuate strap which could be extended through loops in a flat arcuate pad similar in shape to body portions 16 of pad 10 but without the upstanding wedges or similar upstanding projections therein. This is significant because a typical shoulder is narrower at the outer point of the shoulder than it is closer to the neck. By pinching the strap in the manner effected by pad 10, the strap in effect defines a radius of curvature in a vertical plane along the inner edge thereof which is greater than the vertical radius of curvature along the outer edge thereof. Thus, body portion 16 causes the shoulder strap 12 to more closely mate with the contour of one's shoulder than would a flat continuous curved strap and as a result, the pad 10 more evenly distributes the weight of the load to a greater shoulder area than would be the case with a continuously curved strap and pad.

As described above and illustrated in the drawings, the body portion 16 of pad 10 is formed in a bowed and arcuate configuration. Thus the strap support surface 18 is both arcuate and convex. The underside of the pad which defines the shoulder abutment surface 19 is arcuate and concave. Such a configuration provides the body portion of the pad with an unstressed contour generally similar to that of the shoulder of the typical user. The angular turns imparted into the strap by the pad more precisely contour the strap to the shoulder and direct the strap from the support surface in an outward declination toward the object thereby. By forming the body portion of the pad of a flexible material, the weight of the load carried by the strap in turn more precisely conforms the body portion to the shoulder contour. Thus, the more flexible the body portion of the pad, the less the body portion need conform in a relaxed or unstressed state to the contour of the user's shoulder to reduce discomfort and slippage. Accordingly, while a bowed and arcuate configuration is still preferred for the body portion of the shoulder pad of the present invention to maximize the benefits of the present invention, the body portion could be formed in a flat arcuate configuration wherein the shoulder abutment surface 19 would lie in a flat plan in an unstressed state so long as the body portion was highly flexible.

While not believed necessary to significantly increase the comfort of shoulder straps, the arcuate and bowed body portion 16 of pad 10 could also be formed with different inner and outer vertical radii to conform even more closely to the contour of a typical shoulder. Such an embodiment is illustrated in FIG. 14. As seen therein, the radius "R" defined in a vertical plane by inner edge 24 of the strap support surface defined by body portion 16 is greater than the vertical radius "r" defined by the outer edge 28 of the surface. By so inclining the body portion 16 of the pad from the outer edge thereof to the inner edge and without altering any of the other features thereof, the body portion of the pad will more closely mate with the contour of one's shoulder and thereby even more effectively distribute the load of the carrying bag 14 across the shoulder. It has been found, however, that with the embodiment of the pad illustrated in FIGS. 1–8, wherein these different vertical radii of curvature in the body portion of the pad are not shown, that the effect of the wedges, clip members and web portions of the body portion effectively contoured the strap to the shoulders so as to significantly improve the comfort level provided by pad 10 and substantially reduce the tendency of the pad to slide off one's shoulder.

Figure 8:
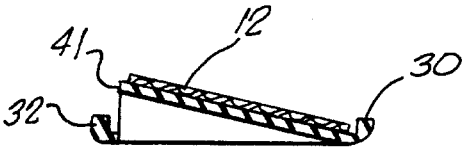
FIG. 8 is a sectional view taken along the line 8—8 in FIG. 3.
Figure 9:
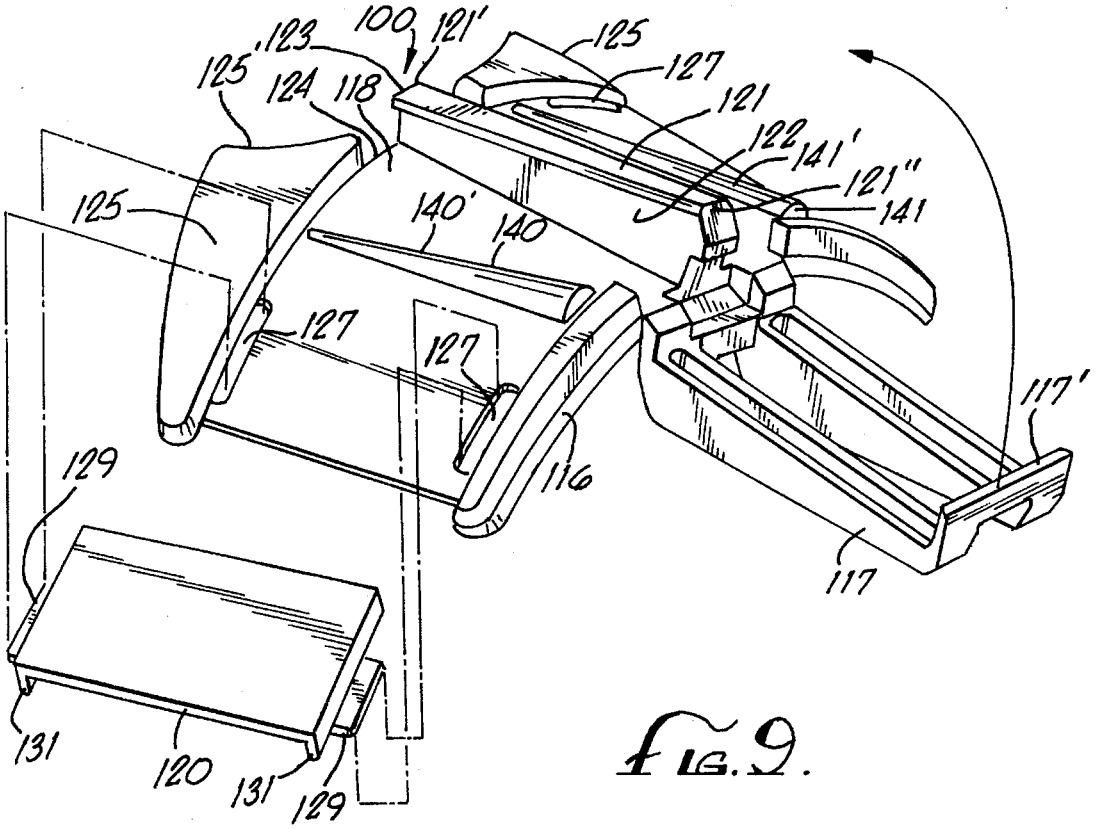
FIG. 9 is an exploded perspective view of a second embodiment of the shoulder pad of the present invention.
Figure 10:
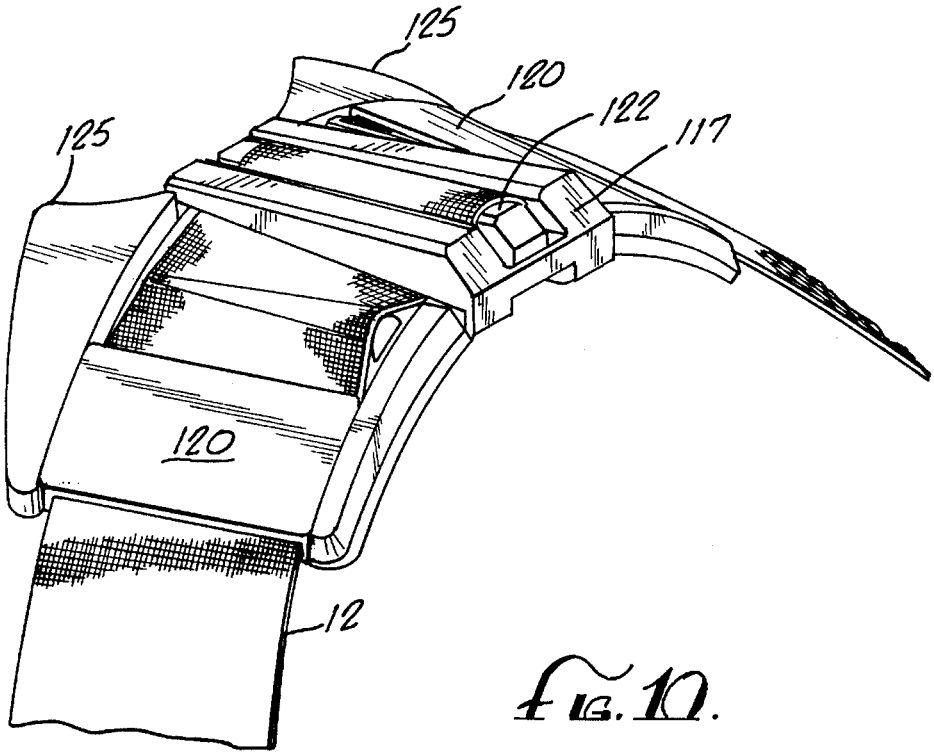
FIG. 10 is a perspective view of the second embodiment of the shoulder pad secured to a shoulder strap.

FIGS. 8 and 9 illustrate an alternate embodiment of the invention. Pad 100 illustrated therein includes several modifications of pad 10 of the prior embodiment and differs from pad 10 in two significant respects. The locking clip 117 is hingedly connected to the body portion 116 of pad 100 adjacent an edge portion thereof as opposed to being removable as in the prior embodiment. The strap retaining members 120 which serve the same function as webs 20 in the prior embodiment are removable from the body portion 116. As a result, the locking clip 117 is always attached to the body portion of the pad and cannot be misplaced and the removable strap retaining members 120 allow the pad 100 to be secured to and removed from a shoulder strap 12 without having to remove the strap from the object carried thereby.

The body portion 116 of shoulder pad 100 defines a strap support surface 118 having the same bowed configuration as surface 18 of the prior embodiment. The central wedge 122 formed on support surface 118, however, does not define inclined side walls like wedge 22, but substantially vertical side walls and a relatively flat upper surface 121 which is inclined upwardly from its inner end 121' to its outer end 121". Surface 121 could also be rounded or tapered like wedge 22. The inner end 121' of wedge 120 defines a cantilevered portion 123 which cooperates with the slotted bar portion 117' of the pivotally mounted locking clip 117 to hold the clip in the closed position about wedge 122 and a portion of shoulder strap 12 and pinch the strap about the wedge to effect the desired outward turn in the strap. Strap support surface 118 also includes secondary wedges 140 and 141 projecting upwardly therefrom and transversing portions of the support surface 118. Secondary wedges are shown as defining slightly rounded upper inclined surfaces 140' and 141' respectively. As with the central wedge 122, the particular contour of the inclined secondary wedges can be varied without affecting the operative characteristics of the wedges.

The inner edge portion 124 of strap support surface 118 can be provided with inwardly extending lateral projections 125 integrally formed with body portion 116 to provide the inner edge portion of the pad with a curved surface 125' to contour the inner edge of pad 100 to the base of the user's neck. A pair of elongated slots 127 are provided in the support surface 118 adjacent the inner and outer edge portions thereof and proximate the extended ends of surface 118 to receive the projecting locking tabs 129 defined by the strap retaining members 120. Tabs 129 are formed on and project outwardly from the lower ends of depending side walls portions 131 of members 120 so as to space the underside of retaining members 120 slightly above portions of the strap support surface 118 and thereby allow the shoulder strap to extend therebetween, while holding the portions of the strap therebelow against surface 118 to effect the drawing of the strap about inclined secondary wedges 140 and 141.

To secure shoulder pad 100 to a shoulder strap, it is only necessary to release the engagement of the bar portion 117' of locking clip 117 from the cantilevered portion 123 of wedge 122, remove the strap retention members 120, place a mid-portion of the shoulder strap along support surface 118 such that the inner edge of the strap is proximate the inner edge 124 of the support surface, press the portion of the shoulder strap extending about wedge 122 against the side of the wedge, and pivot the locking clip 117 back into the locked position about the shoulder strap. The strap retention members 120 are then snapped backed into place over the shoulder strap, completing the securement of the pad to the strap. So secured, the positioning of the pad on the strap can be adjusted without having to disengage clip member 117 by holding the body portion of the pad in one hand and pulling firmly on one end of the strap. The securement afforded by clip 117, however, will not allow the pad to slide on the strap during use. This is also true for the prior embodiment.

FIGS. 11–13 illustrate the application of the principles of the present invention for alternative strap uses. As shown therein, different angles are created in a strap 212 by using a plurality of wedges (e.g., 222, 224 and 226) of different elevations in combination with a plurality of strap retention elements 220 disposed laterally of the wedges. The strap retention elements could be of the snap-on configuration such as members 120 illustrated in FIGS. 9 and 10 or be pivotally mounted onto the body portion of the pad like strap retention clip 117. They could also include permanently affixed webs such as webs 20 in pad 10 or employ combinations of such mountings. Similarly, by using a plurality of oppositely aligned wedges, (apex proximate the inner edge portion of the pad) in combination with wedges aligned as described above, S-shapes or other strap contours could be created in combination with a plurality of strap retention elements for use in different strap applications, as for example, on a backpack.

In other modifications of the shoulder pad of the present invention, the strap retention members 120 could be pivotally mounted on the body portion of the pad similarly to the mounting of locking clip 117. Locking clip 117 could also be pivotally secured on the inner edge of the body portion of the pad as opposed to the outer edge portion as shown in FIG. 9 and different configurations of locking clips and hinge mechanisms could be employed. For example, hinge pins could be used in lieu of the living hinge illustrated in FIG. 9 and the locking clip constructed in a U-shape wherein the pivot pins would be disposed in the inner ends of the leg portions of the clip. Shoulder pads embodying the present invention could also comprise two or more inclined wedges such as wedges 40 and 41 or 140 and 141 without the use of a centrally disposed wedge. In such an embodiment, a plurality of suitably configured securement clips, strap retention webs or a combination thereof could be employed. Various other changes and modifications could be made in carrying out the present invention without departing from the spirit and scope thereof. Insofar as these changes and modifications are within the purview of the appended claims, they are to be considered as part of the present invention.

I claim:

1. A shoulder pad for use with a shoulder strap for improving the distribution of the weight on a user's shoulder of an object carried by the strap and thereby decreasing both the discomfort created by the strap on the shoulder and the tendency of the strap to slide off the shoulder, said pad comprising:

a flexible body portion defining an inner edge, an outer edge and an arcuate strap support surface disposed therebetween, said support surface defining a first inclined wedge substantially transversely aligned with said inner and outer edges at a mid-point of said support surface and being inclined upwardly toward said outer edge, and a pair of strap retention members spaced from and transversing said support surface proximate opposing ends of said surface for retaining portions of the shoulder strap between said retention members and said support surface; and a strap retaining clip defining means thereon cooperating with said body portion for releasably securing said clip about said wedge and leg portions transversing said support surface substantially adjacent opposite sides of said wedge for pinching portions of said shoulder strap between said leg portions and said wedge, securing said body portion to the strap and causing said strap to turn outwardly from said wedge whereby upon positioning the shoulder strap with said pad secured thereto across the user's shoulder such that said pad bears against the shoulder with the inner edge thereof proximate the user's neck, the strap substantially follows the contour of the shoulder and projects downwardly from said pad at an outward declination toward the object carried by the strap, thereby distributing the weight of the object across the pad to a larger area of the user's shoulder.

2. The shoulder pad of claim 1 including a pair of inclined second wedges defined by and transversing said support surface between said first inclined wedge and said strap retention members, respectively, said members and said retaining clip cooperating to press portions of said strap about said second wedges to cause the strap to turn outwardly from said second wedges.

3. The shoulder pad of claim 1 wherein said body portion defines a channel extending into said first wedge adjacent the outer edge of said body portion and a pair of clip receiving slots disposed on opposite sides of said first wedge adjacent said inner edge of said body portion, said strap retaining clip defines a bar portion extending between said leg portion thereof and a projection extending from said bar portion between said leg portions and wherein said leg portions are resilient and define laterally extending foot portions at the extended ends thereof, the spacing between said foot portions being greater than the spacing between said slots, said retaining clip being secured to said body portion to effect the pinching of said strap about said first wedge and the securement of said pad to said strap upon extending said laterally projecting foot portions on said clip through said slots and said projection on said bar portion of clip into said channel.

4. The shoulder pad of claim 1 wherein said strap retention members are movable from a first position transversing said strap support surface to a second position exposing said surface to enable a shoulder strap to be placed on said strap support surface and wherein said members define means thereon cooperating with said body portion for releasibly securing said members in said first position to retain portions of said shoulder strap between said retention members and said support surface.

5. The shoulder strap of claim 1 wherein said retaining clip is hingely mounted on said body portion of said pad adjacent one of said edges thereof.

6. The shoulder pad of claim 1 wherein said retaining clip is hingely mounted on said body portion of said pad adjacent one of said edges thereof and said strap retention members are movable from a first position transversing said strap support surface to a second position exposing said surface to enable a shoulder strap to be placed on said strap support surface and wherein said members define means thereon cooperating with said body portion for releasibly securing said members in said first position to retain portions of said shoulder strap between said retention members and said support surface.

7. The shoulder pad of claim 2 wherein said first wedge defines a first apex proximate said outer edge of said body portion of said pad, said apex being spaced a first distance above portions of said strap support surface adjacent said first wedge, said second wedges each define a second apex proximate said outer edge of said body portion, each of said second apexes being spaced a second distance above said portions of said surface, and wherein said first distance is greater than said second distance.

8. The shoulder pad of claim 5 including a pair of inclined second wedges defined by and transversing said support surface between said first inclined wedge and said strap retention members, said members and said retaining clip cooperating to press portions of said strap about said second wedges to cause the strap to turn outwardly from said second wedges.

9. The shoulder pad of claim 2 wherein said strap retention members are movable from a first position transversing said strap support surface to a second position exposing said surface to enable a shoulder strap to be placed on said strap support surface and wherein said members define means thereon cooperating with said body portion for releasibly securing said members in said first position to retain portions of said shoulder strap between said retention members and said support surface.

10. The shoulder strap of claim 9 wherein said retaining clip is hingely mounted on said body portion of said pad adjacent one of said edges thereof.

11. A shoulder pad for use with a shoulder strap for improving the distribution of the weight on a user's shoulder of an object carried by the strap and thereby decreasing both the discomfort created by the strap on the shoulder and the tendency of the strap to slide off the shoulder, said pad comprising:

a flexible body portion defining an arcuate concave shoulder support surface on the underside thereof, a convex arcuate shoulder strap supporting surface on the upper side thereof, an inner edge, an outer edge, said inner edge defining a first radius in a vertical plane, said outer edge defining a second radius in a vertical plane, said first radius being greater than said second radius, said strap support surface defining a first inclined wedge substantially transversely aligned with said inner and outer edges at a mid-portion of said support surface and being inclined upwardly toward said outer edge, and a pair of strap retention members spaced from and transversing said support surface proximate opposing ends of said surface for retaining portions of the shoulder strap between said retention members and said support surface; and a strap retaining clip defining means thereon cooperating with said body portion for releasibly securing said clip about said wedge and leg portions transversing said support surface substantially adjacent opposite sides of said wedge for pinching portions of said shoulder strap between said leg portions and said wedge, securing said body portion to the strap and causing said strap to turn outwardly from said wedge whereby upon positioning the shoulder strap with said pad secured thereto across the user's shoulder such that said pad bears against the shoulder with the inner edge thereof proximate the user's neck, the strap substantially follows the contour of the shoulder and projects downwardly from said pad at an outward declination toward the object carried by the strap, thereby distributing the weight of the object across the pad to a larger area of the user's shoulder.

12. The shoulder pad of claim 11 including a pair of inclined second wedges defined by and transversing said support surface between said first inclined wedge and said strap retention members, respectively, said members and said retaining clip cooperating to press portions of said strap about said second wedges to cause the strap to turn outwardly from said second wedges.

13. The shoulder pad of claim 11 wherein said body portion defines a channel extending into said first wedge adjacent the outer edge of said body portion and a pair of clip receiving slots disposed on opposite sides of said first wedge adjacent said inner edge of said body portion, said strap retaining clip defines a bar portion extending between said leg portion thereof and a projection extending from said bar portion between said leg portions and wherein said leg portions are resilient and define laterally extending foot portions at the extended ends thereof, the spacing between said foot portions being greater than the spacing between said slots, said retaining clip being secured to said body portion to effect the pinching of said strap about said first wedge and the securement of said pad to said strap upon extending said laterally projecting foot portions on said clip through said slots and said projection on said bar portion of clip into said channel.

14. The shoulder pad of claim 11 wherein said strap retention members are movable from a first position transversing said strap support surface to a second position exposing said surface to enable a shoulder strap to be placed on said strap support surface and wherein said members define means thereon cooperating with said body portion for releasibly securing said members in said first position to retain portions of said shoulder strap between said retention members and said support surface.

15. The shoulder strap of claim 12 wherein said retaining clip is hingely mounted on said body portion of said pad adjacent one of said edges thereof.

16. A shoulder pad for use with a shoulder strap for improving the distribution of the weight on a user's shoulder of an object carried by the strap and thereby decreasing both the discomfort created by the strap on the shoulder and the tendency of the strap to slide off the shoulder, said pad comprising:

a flexible body portion defining an arcuate concave shoulder support surface on the underside thereof, a convex arcuate shoulder strap supporting surface on the upper side thereof, an inner edge and an outer edge, said strap support surface defining a first inclined wedge centrally disposed on said support surface and substantially transversely aligned with said inner and outer edges, said wedge being inclined upwardly toward said outer edge and defining an apex adjacent said outer edge, said apex being disposed a first distance above portions of said support surface adjacent said first wedge, a pair of inclined second wedges transversing said support surface on opposite sides of and spaced equidistantly from said first wedge, said second wedges defining apexes proximate said outer edge of said body portion, said second apexes being disposed a second distance above said portions of said support surface, said first distance being greater than said second distance, and a pair of strap retention members spaced from and transversing said support surface proximate opposing ends of said surface for retaining portions of said shoulder strap between said members and said support surface, respectively; and a strap retaining clip defining the means thereon cooperating with said body portion for releasibly securing said clip about said first wedge and leg portions transversing said strap support surface substantially adjacent opposite sides of said first wedge for pinching portions of said shoulder strap between said leg portions and said first wedge, securing said body portion to the strap and causing said strap to turn outwardly from said first wedge, whereby upon pulling on portions of said strap projecting from said pad, said strap is forced by said strap retaining clip and said strap retention members against said second wedges, causing said strap to turn outwardly from said second wedges such that upon positioning the shoulder strap with said pad secured thereto across the user's shoulder such that said shoulder support surface of said pad bears against the shoulder and the inner edge of the body portion is proximate the user's neck, the strap projects at an outward declination toward said object and substantially follows the contour of the shoulder, distributing the weight of the object across the pad to a larger area of the shoulder.

17. The shoulder pad of claim 16 wherein said inner edge of said body portion defines a first radius in a vertical plane, said outer radius defines a second radius in a vertical plane and said first radius is greater than said second radius.

18. The shoulder pad of claim 16 wherein said body portion of said pad defines a channel extending into said first wedge adjacent the outer edge of said body portion and a pair of clip receiving slots disposed on opposite sides of said first wedge adjacent said inner edge of said body portion, said strap retaining clip defines a bar portion extending between said leg portion thereof and a projection extending from said bar portion between said leg portions and wherein said leg portions are resilient and define laterally extending foot portions at the extended ends thereof, the spacing between said foot portions being greater than the spacing between said slots, said retaining clip being secured to said body portion to effect the pinching of said strap about said first and second wedges and the securement of said pad to said strap upon extending said laterally projecting foot portions on said clip through said slots and said projection on said bar portion of said clip into said channel.

19. The shoulder pad of claim 16 wherein said strap retention members are movable from a first position transversing said strap support surface to a second position exposing said surface to enable a shoulder strap to be placed on said strap support surface and wherein said members define means thereon cooperating with said body portion for releasibly securing said members in said first position to retain portions of said shoulder strap between said retention members and said support surface.

20. The shoulder strap of claim 19 wherein said clip member is hingely mounted on said body portion of said pad adjacent one of said edges thereof.

21. A shoulder pad for use with a shoulder strap for improving the distribution of the weight on a user's shoulder of an object carried by the strap and thereby decreasing the discomfort created by the strap on the shoulder, said pad comprising:

a flexible body portion defining an inner edge, an outer edge, and an arcuate strap support surface extending therebetween, said support surface defining a plurality of inclined wedges each being substantially transversely aligned with said inner and outer edges and each being inclined upwardly toward said outer edge, strap retention means carried by said body portion for pressing portions of said strap about each of said inclined wedges and thereby causing said strap to turn about each of said wedges whereby upon positioning the shoulder strap across the user's shoulder, said pad bears against the shoulder and said strap substantially follows the contour of the shoulder and projects from said pad toward the object carried by the strap, thereby distributing the weight of the object across the pad to a larger area of the shoulder.

22. The shoulder pad of claim 21 wherein each of said wedges defines an apex proximate an edge of said body portion and wherein the apex defined by at least one said wedge is spaced upwardly from an adjacent portion of said support surface a distance greater than the apex defined by a second wedge disposed adjacent said portion of said support surface whereby the angle of the turn imparted to the shoulder strap by said one wedge is sharper than the angle of the turns imparted to the shoulder strap by said second wedge.

23. A shoulder pad for use with a shoulder strap for improving the distribution of the weight on a user's shoulder of an object carried by the strap and thereby decreasing both the discomfort created by the strap on the shoulder and the tendency of the strap to slide off the shoulder, said pad comprising:

a flexible body portion defining an inner edge, an outer edge and an arcuate strap support surface disposed therebetween, said support surface defining a first projection extending upwardly therefrom proximate said outer edge, and a pair of strap retention members spaced from said first projection and substantially transversely aligned with said inner and outer edges proximate opposing ends of said surface for retaining portions of the shoulder strap between said retention members and said support surface; and a strap retaining clip defining means thereon cooperating with said body portion for releasibly securing said clip about said first projection and leg portions transversing said support surface substantially adjacent opposite sides of said first projection for pinching portions of said shoulder strap between said leg portions and said first projection, securing said body portion to the strap and causing said strap to turn outwardly from said projection whereby upon positioning the shoulder strap with said pad secured thereto across the user's shoulder such that said pad bears against the shoulder with the inner edge thereof proximate the user's neck, the strap substantially follows the contour of the shoulder and projects downwardly from said pad at an outward declination toward the object carried by the strap, thereby distributing the weight of the object across the pad to a larger area of the user's shoulder.

24. The shoulder pad of claim 23 including a pair of second projections extending upwardly from said support surface proximate said outer edge between said first projection and said strap retention members, said members and said retaining clip cooperating to press portions of said strap about said second projections to cause the strap to turn outwardly from said second projections.

25. A shoulder pad for use with a shoulder strap for improving the distribution of the weight on a user's shoulder of an object carried by the strap and thereby decreasing both the discomfort created by the strap on the shoulder and the tendency of the strap to slide off the shoulder, said pad comprising:

a flexible body portion defining an inner edge, an outer edge and an arcuate strap support surface disposed therebetween, said support surface defining a first inclined wedge substantially transversely aligned with said inner and outer edges at a mid-point of said support surface and being inclined upwardly toward said outer edge; and a strap retaining clip defining means thereon cooperating with said body portion for releasibly securing said clip about said wedge and leg portions transversing said support surface substantially adjacent opposite sides of said wedge for pinching portions of said shoulder strap between said leg portions and said wedge, securing said body portion to the strap and causing said strap to turn outwardly from said wedge whereby upon positioning the shoulder strap with said pad secured thereto across the user's shoulder such that said pad bears against the shoulder with the inner edge thereof proximate the user's neck, the strap substantially follows the contour of the shoulder and projects downwardly from said pad at an outward declination toward the object carried by the strap, thereby distributing the weight of the object across the pad to a larger area of the user's shoulder.

26. A shoulder pad for use with a shoulder strap for improving the distribution of the weight on a user's shoulder of an object carried by the strap and thereby decreasing both the discomfort created by the strap on the shoulder and the tendency of the strap to slide off the shoulder, said pad comprising:

a flexible body portion defining an inner edge, an outer edge and an arcuate strap support surface disposed therebetween, said support surface defining a first projection extending upwardly therefrom proximate said outer edge; and a strap retaining clip defining means thereon cooperating with said body portion for releasibly securing said clip about said first projection and leg portions transversing said support surface substantially adjacent opposite sides of said projection for pinching portions of said shoulder strap between said leg portions and said projection, securing said body portion to the strap and causing said strap to turn outwardly from said projection whereby upon positioning the shoulder strap with said pad secured thereto across the user's shoulder such that said pad bears against the shoulder with the inner edge thereof proximate the user's neck, the strap substantially follows the contour of the shoulder and projects downwardly from said pad at an outward declination toward the object carried by the strap, thereby distributing the weight of the object across the pad to a larger area of the user's shoulder.

27. The shoulder pad of claim 26 including a pair of strap retention members spaced from and transversing said support surface proximate opposing ends of said surface for retaining portions of the shoulder strap between said retention members and said support surface.

28. The shoulder pad of claim 27 further including a pair of second projections extending upwardly from said support surface proximate said outer edge between said one projection and said strap retention members, said members and said retaining clip cooperating to press portions of said strap about said second projections to cause the strap to turn outwardly from said second projections.

* * * * *